US009389030B2

(12) United States Patent
Reuter et al.

(10) Patent No.: US 9,389,030 B2
(45) Date of Patent: Jul. 12, 2016

(54) SPLASH GRIDS FOR RAIN OR SPRAY ZONES

(75) Inventors: Hanno Carl Rudolf Reuter, Western Cape Province (ZA); Detlev Gustav Kröger, Western Cape Province (ZA)

(73) Assignee: STELLENBOSCH UNIVERSITY, Stellenbosch, Western Cape Province (ZA)

( * ) Notice: Subject to any disclaimer, the term of this patent is extended or adjusted under 35 U.S.C. 154(b) by 131 days.

(21) Appl. No.: 14/232,735

(22) PCT Filed: Jul. 10, 2012

(86) PCT No.: PCT/IB2012/053510

§ 371 (c)(1),
(2), (4) Date: Jan. 14, 2014

(87) PCT Pub. No.: WO2013/011413

PCT Pub. Date: Jan. 24, 2013

(65) Prior Publication Data

US 2014/0151910 A1 Jun. 5, 2014

(30) Foreign Application Priority Data

Jul. 15, 2011 (ZA) ..... 2011/05233

(51) Int. Cl.
*B01F 3/04* (2006.01)
*F28F 25/08* (2006.01)

(52) U.S. Cl.
CPC ..... *F28F 25/085* (2013.01); *F28F 25/082* (2013.01)

(58) Field of Classification Search
CPC ..... F28F 25/082; F28F 25/085
USPC ..... 261/108, 110, 111, DIG. 11
See application file for complete search history.

(56) References Cited

U.S. PATENT DOCUMENTS 2,002,065 A 5/1935 Kryszewski
2,060,275 A 11/1936 Barry (Continued)

FOREIGN PATENT DOCUMENTS

CH 614 770 A5 * 12/1979
GB 00362 A 0/1909

(Continued)

*Primary Examiner* — Charles Bushey
(74) *Attorney, Agent, or Firm* — Knobbe, Martens, Olson & Bear, LLP

(57) ABSTRACT

A splash grid is provided for installation in a rain zone of liquid gas contacting industrial equipment. The splash grid has a supporting frame assembly and multiple generally parallel elongate elements supported by the frame assembly. The elongate elements each has a transverse dimension, in plan view, not exceeding 3 mm, and a spacing in plan view not exceeding 10 mm. The elongate elements may be of a molded plastic material that is optionally integral with a surround that forms, or is attached to, the supporting frame assembly. Alternatively, the elongate elements may be separately manufactured flexible filament or cord supported by a surround that forms or is attached to the supporting frame assembly. The elongate elements may be staggered in the vertical direction and gaps may be provided for larger objects to pass through the splash grid. A liquid cooling installation having a rain zone fitted with a splash grid is also provided.

11 Claims, 4 Drawing Sheets

(56) References Cited

U.S. PATENT DOCUMENTS 2,342,952 A * 2/1944 Mart ..... F28F 25/082 211/182
2,733,055 A * 1/1956 Ophuls ..... F28C 1/04 261/113
3,378,239 A * 4/1968 Engalitcheff, Jr. .... B01F 5/0617 261/110
3,643,931 A * 2/1972 Henning ..... F28F 25/06 261/111
3,751,017 A * 8/1973 Lemmens ..... F28F 25/085 261/111
3,791,634 A * 2/1974 Phelps ..... F28F 25/085 261/111
3,797,810 A * 3/1974 Wolff ..... B01D 3/16 261/111
4,269,795 A * 5/1981 Bosman ..... F28F 25/082 248/340
4,451,411 A * 5/1984 Lefevre ..... F28F 25/085 248/544
4,803,018 A 2/1989 Lefevre

FOREIGN PATENT DOCUMENTS

GB 154259 A 11/1920
GB 1168654 A 10/1969
GB 2020192 A 11/1979
GB 1568696 A 6/1980
JP 52-75663 * 6/1977

* cited by examiner

SPLASH GRIDS FOR RAIN OR SPRAY ZONES

FIELD OF THE INVENTION

This invention relates to a splash grid for use in industrial equipment in which rain or spray zones are generated with liquid, typically water or an aqueous solution in the form of drops, being in contact with a gas, typically air, with a consequent heat and mass transfer between the two phases. Such industrial equipment includes cooling towers commonly associated with thermal electrical power plants and applies to rain or spray zones in which drops fall under the influence of gravity or are propelled by a spray device.

BACKGROUND TO THE INVENTION

Power plant efficiency is generally determined by projected electricity tariffs and power plant life cycle costs during the design phase. By improving technology, life cycle costs can be reduced thus making it possible to improve power plant efficiency economically.

Splash grid types of fills are used in cooling towers to enhance heat and mass transfer, in particular when cooling water quality is poor. Commercially available splash grids are, however, not specifically designed for reducing the drop size to a satisfactorily effective level and the drops of water falling from the existing splash grids to create a rain zone beneath them, are rather large. Existing splash grids have large open areas through which drops can pass without impingement on the grid.

Rain or spray zones comprise liquid drops with a polydisperse size distribution freefalling under gravity in moving or stationary gas. In rain zones below cooling tower fills or packing, the drops drip from the base of the fill, whereas in spray zones, the drops are produced by sprayers.

It has been demonstrated semi-empirically using computational fluid dynamic models that the performance of cooling tower rain zones and thus cooling towers can be increased significantly for different cases investigated, by reducing the Sauter mean drop diameter in the rain zone.

It would be desirable to provide splash grids that may be used to enhance the performance of the rain zone below a conventional cooling tower fill and to thereby enhance the thermal performance of a cooling tower and result in a reduction in power plant costs and that may also be used in any other appropriate rain or spray zone situation.

It would also be desirable to provide splash grids suitable for achieving a drop size reduction in multiple liquid drops freefalling under the influence of gravity in moving or stationary gas or vapour for the enhancement of heat and mass transfer performance characteristics.

SUMMARY OF THE INVENTION

In accordance with one aspect of this invention there is provided a splash grid comprising a supporting frame assembly and multiple generally parallel elongate elements supported by the frame assembly, the elongate elements each having a transverse dimension, in plan view, not exceeding 3 mm, and a spacing in plan view not exceeding 10 mm.

Further features of this aspect of the invention provide for the elongate elements to be either of moulded plastics material that is optionally integral with a surround that forms, or is attached to, the supporting frame assembly or alternatively, for the elongate elements to be of a separately manufactured flexible filament or cord supported by a surround that forms or is attached to the supporting frame assembly; for the width of the elongate elements, in plan view, to be from 1 to 3 mm; for the elongate elements to be staggered in the vertical direction in order to diminish gas pressure drop across the splash grid; for the elongate elements to be arranged to optimise the probability of drops impinging on an elongate element during passage through the splash grid; for gaps to be provided in a splash grid or splash grid assembly for larger objects such as sponge balls of a condenser tube cleaning system to pass through the splash grid or splash grid assembly without getting caught and blocking the grid; and for intermediate lateral bracing for support of the elongate elements to be minimised to avoid nodes being formed from which dripping can take place.

Various possibilities exist for the arrangement of the splash grids such that the elongate elements in sectional side view adopt various different positions relative to each other depending on the available space and the requirements. The following are a few possible arrangements that are given by way of example only.

In the event that no larger objects need to be accommodated, the splash grids could simply be in the form of horizontal panels. The splash grids may be arranged in a single layer or more than one layer in which instance the individual elongate elements can be offset relative to each other in the vertical direction to provide the best possible chance of falling drops impinging on an elongate element.

In the event that larger objects need to be accommodated with generally flat panels, they can be inclined somewhat to the horizontal to provide vertical gaps between the lower end of one panel and the upper end of the next panel.

In the event that vertical space is more freely available, the elongate elements may be arranged in groups that are alternately higher and lower so that gaps for larger objects are provided between the terminal elongate member of one group and the terminal member of the next sub-jacent or superjacent group thereof. The elongate elements in a group may be arranged to follow an arched arrangement so that larger objects landing on a group will tend to roll off towards one side of the group or the other.

Alternatively, the elongate elements may be arranged in flat inclined groups providing inclined gaps between the groups for the passage of larger objects through the splash grid with the inclined groups covering substantially the entire area, in plan view.

In accordance with a second aspect of the invention there is provided a liquid cooling installation including a generally upright flow path, a liquid distribution arrangement for liquid to be cooled in an upper region thereof, a conventional or similar fill below the liquid distribution arrangement and over which the liquid to be cooled is to flow, in use, and a rain zone beneath the conventional or similar fill, the liquid cooling installation being characterised in that splash grids as defined above are installed within the rain zone above a liquid collection facility in a lower region of the installation.

Further features of this aspect of the invention provide for the splash grids to be positioned between 200 mm and 600 mm below the fill; and for the liquid cooling installation to be a cooling tower of otherwise generally conventional construction.

In order that the invention may be more fully understood various configurations of splash grids will be described below with reference to the accompanying drawings.

DETAILED DESCRIPTION WITH REFERENCE TO THE DRAWINGS

Figure 1:
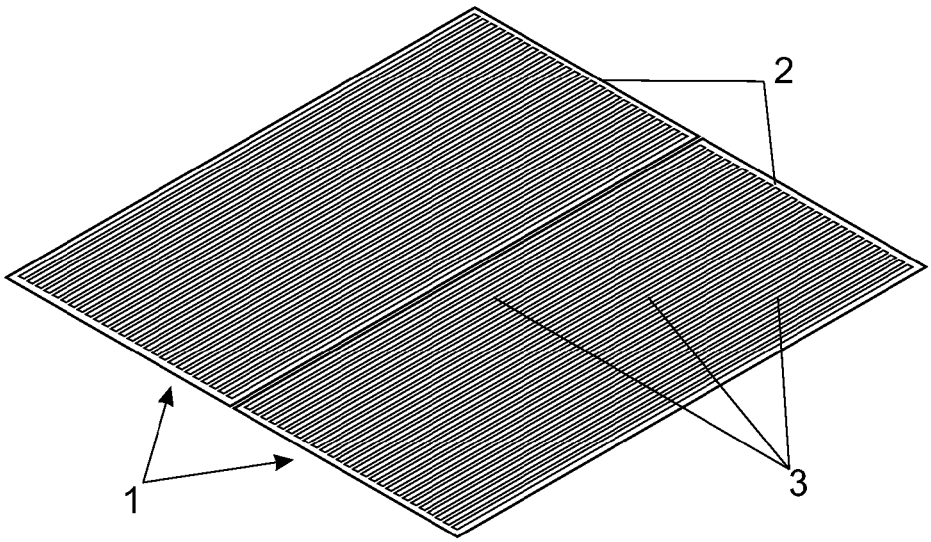
FIG. 1 is an isometric view of two generally planar splash grid panels.
Figure 2:
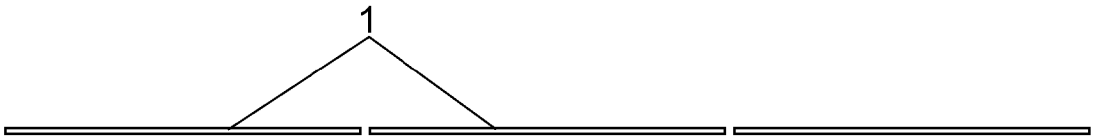
FIG. 2 is a schematic side elevation of one arrangement of splash grid panels in which no larger objects are to be accommodated.
Figure 4:
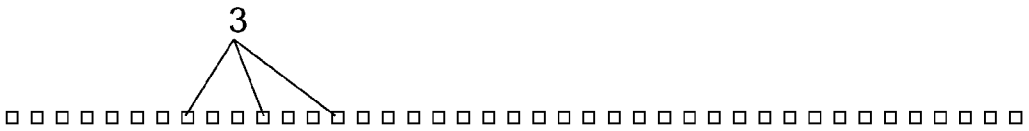
FIG. 4 is a schematic sectional view through a simple panel of the type illustrated in FIG. 2.

In the simplest embodiment of the invention, as illustrated in FIGS. 1, 2 and 4, a splash grid comprises injection moulded plastics panels, generally indicated by numeral (1), each of which comprises a surround (2) having integral multiple generally parallel elongate elements (3) supported by the surround. Each elongate element has a transverse dimension, in plan view, not exceeding 3 mm, and conveniently about 2 mm, and a spacing in plan view of about 5 mm.

The elongate elements are, in this instance, of moulded plastics material but they could be of a separately manufactured flexible filament or cord supported by the surround. Also, in this embodiment of the invention, the elongate elements are of square or rectangular cross-section but they could be of any other suitable cross-sectional shape.

In the arrangement illustrated in FIGS. 1, 2 and 4, the splash grids are arranged in a single horizontal layer. In such an instance there is no provision made for accommodating larger objects passing through the splash grids.

Figure 5:
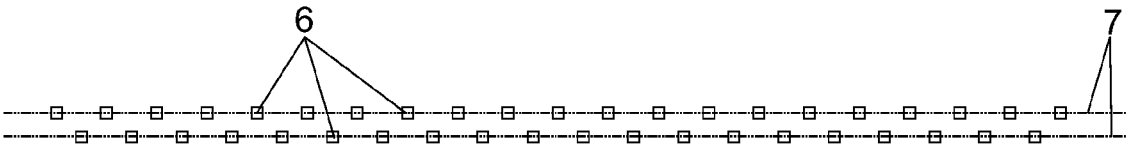
FIG. 5 is a similar schematic sectional view through a splash grid in which the elongate elements are arranged into vertically spaced planes.

As a variation to this arrangement, and as shown in FIG. 5, the elongate elements (6) may be arranged in two different horizontal planes (7) with the elongate elements in one plane being offset in the vertical direction relative to those in the other plane. This arrangement increases the space between the elongate elements that is available for the flow of gas through the splash grid.

Figure 3:
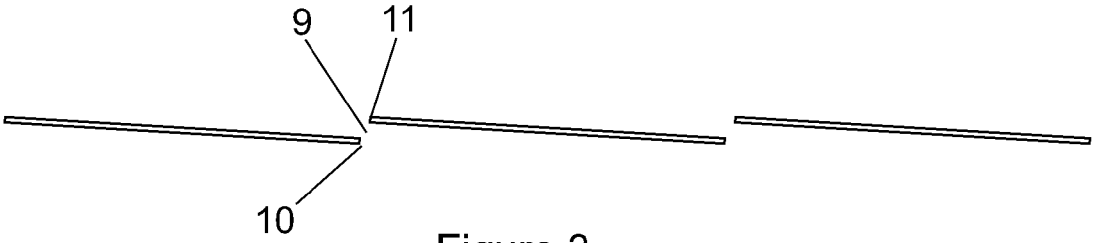
FIG. 3 is a schematic side elevation of a second arrangement of splash grid panels in which larger objects are to be accommodated and the panels are inclined to the horizontal.

In the event that larger objects need to be accommodated, and as illustrated in FIG. 3, the generally flat panels can be inclined somewhat to the horizontal to provide vertical gaps (9) between the lower end (10) of one panel and the upper end (11) of the next panel.

Figure 6:
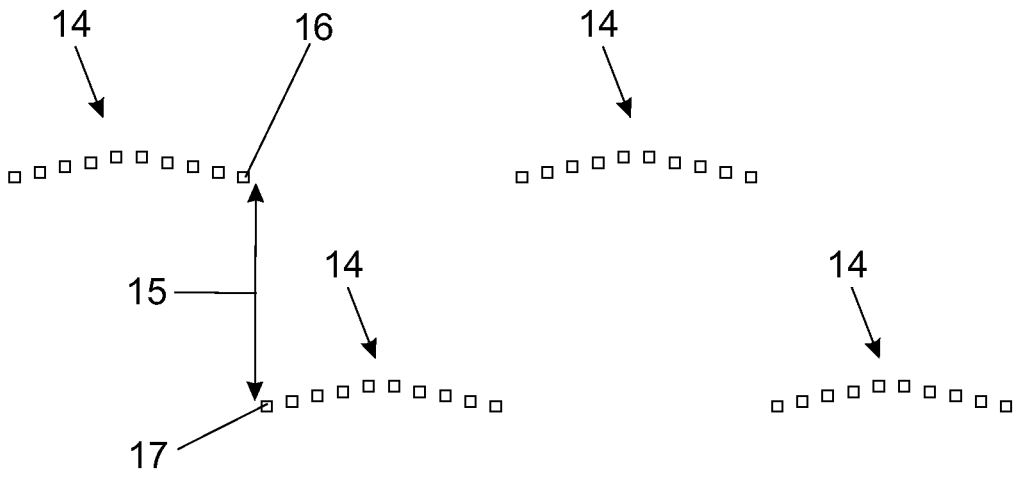
FIG. 6 is a similar schematic sectional view through a splash grid in which the elongate elements are arranged in vertically spaced groups.

In the event that vertical space is more freely available, and as shown in FIG. 6, the elongate elements may be arranged in groups (14) that are alternately higher and lower so that lateral gaps (15) for larger objects are provided between the terminal elongate member (16) of one group and the terminal member (17) of the next sub-jacent or super-jacent group thereof. The elongate elements in a group may be arranged to follow an arched arrangement so that larger objects landing on a group will tend to roll off towards one side of the group or the other.

Figure 7:
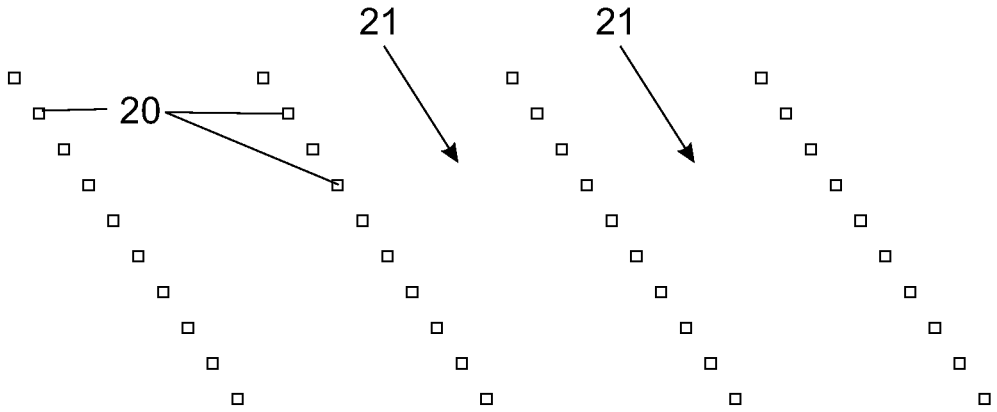
FIG. 7 is a similar schematic sectional view through a splash grid in which the elongate elements are arranged in spaced inclined planes; and, FIG. 8 is a schematic sectional elevation through a liquid cooling installation according to the invention.

Alternatively, and as shown in FIG. 7, the elongate elements (20) may be arranged in flat inclined groups providing inclined gaps (21) between the groups for the passage of larger objects through the splash grid. The elongate elements are arranged to substantially cover the entire area in plan view.

In all cases the elongate elements are arranged to optimise the probability of drops impinging on them during passage through the splash grid. Also, any intermediate or lateral bracing for supporting the elongate elements is minimised in order to avoid nodes being created from which dripping could be promoted.

Figure 8:
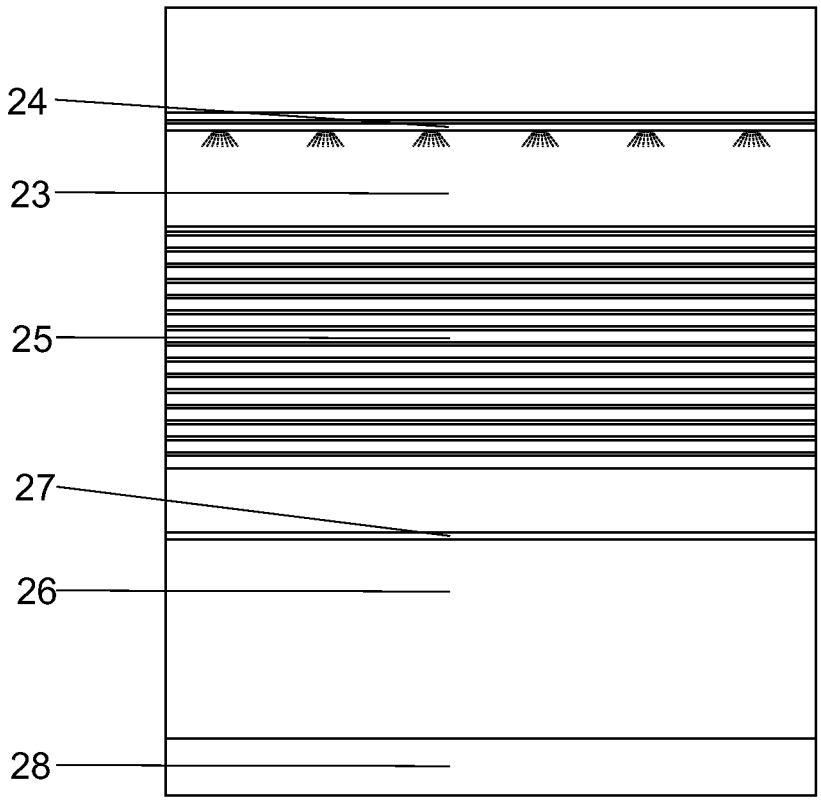

Referring now to FIG. 8 of the drawings, and as provided by the second aspect of the invention, a liquid cooling installation, such as may be associated with a conventional cooling tower, includes a generally upright flow path (23) having in an upper region thereof a liquid distribution arrangement (24) for liquid to be cooled. The liquid distribution arrangement distributes liquid, typically hot water, over a conventional fill (25) over which the water is to flow, in use. This creates a rain zone (26) beneath the fill and splash grids (27) of any of the types described above are installed within the rain zone above a liquid collection facility (28) in a lower region of the installation. As indicated above, the splash grids are preferably positioned between about 200 mm and 600 mm below the fill.

It is to be noted that the efficiency of a thermal power plant is strongly dependent on the performance of its cooling system. From thermodynamics, a 3° C. reduction in steam temperature in the condenser or steam turbine exhaust of a modern power plant, can lead to a more than 1% increase in gross power output and efficiency, depending on the power plant or steam turbine performance characteristics. In wet-cooled power plants, this can be achieved by enhancing cooling tower and condenser performance to reduce the cooling water inlet temperature to the condenser by about 3° C., which will also result in a possible 0.8% reduction in evaporation and blow-down losses due to reduced heat load.

It will be understood that numerous variations may be made to the examples of the invention described above without departing from the scope hereof. Also, the splash grids provided by the invention could be used in air-conditioning units, distillation columns, power plant de-aerators, and fills in some types of seawater desalination plants.

The invention claimed is:

1. A liquid cooling installation comprising:

a generally vertical flow path, a liquid distribution arrangement for a liquid to be cooled in an upper region thereof, a fill below the liquid distribution arrangement, wherein the fill is configured so that, in use, the liquid to be cooled flows over the fill, a rain zone beneath the fill, at least one splash grid installed horizontally within the rain zone, in a manner such that the splash grid does not contact the fill, and a liquid collection facility in a lower region of the liquid cooling installation below the at least one splash grid, wherein the splash grid comprises a supporting frame assembly and multiple generally parallel elongate elements supported by the frame assembly, the elongate elements each having a transverse dimension, in plan view, not exceeding 3 mm, and a spacing in plan view not exceeding 10 mm.

2. A liquid cooling installation as claimed in claim 1, wherein the at least one splash grid is positioned between 200 mm and 600 mm below the fill.

3. A liquid cooling installation as claimed in claim 2 wherein the liquid cooling installation is a cooling tower.

4. A splash grid as claimed in claim 1, wherein the elongate elements are of a molded plastic material that is optionally integral with a surround that forms, or is attached to, the supporting frame assembly.

5. A liquid cooling installation as claimed in claim 1, wherein the elongate elements are separately manufactured flexible filament or cord supported by a surround that forms or is attached to the supporting frame assembly.

6. A liquid cooling installation as claimed in claim 1, wherein the width of the elongate elements, in plan view, is from 1 to 3 mm.

7. A liquid cooling installation as claimed in claim 1, wherein the elongate elements are staggered in the vertical direction.

8. A liquid cooling installation as claimed in claim 1, wherein gaps are provided in the splash grid or a splash grid assembly for larger objects to pass through the splash grid or splash grid assembly without getting caught and blocking the grid.

9. A liquid cooling installation as claimed in claim 8, wherein the grid has a plurality of generally flat panels that are inclined somewhat to the horizontal to provide vertical gaps between the lower end of one panel and the upper end of the next panel.

10. A liquid cooling installation as claimed in claim 8, wherein the elongate elements are arranged in groups that are alternately higher and lower so that gaps for larger objects are provided between a terminal elongate member of one group and a terminal member of a next subjacent or super-jacent group thereof.

11. A liquid cooling installation as claimed in claim 8, wherein the elongate elements are arranged in flat inclined groups providing inclined gaps between the groups for the passage of larger objects through the splash grid with the inclined groups covering substantially the entire area, in plan view.

* * * * *